United States Patent [19]

De Ro et al.

[11] Patent Number: 5,042,394

[45] Date of Patent: Aug. 27, 1991

[54] ARTICULATED DEVICE FOR THE GUIDANCE AND LEVITATION OF A RAIL VEHICLE

[75] Inventors: Michel D. De Ro; Christian J. Terreur, both of Nivelles, Belgium

[73] Assignee: Constructions Ferroviaires Et Metalliques S. A., Belgium

[21] Appl. No.: 369,582

[22] Filed: Jun. 21, 1989

[30] Foreign Application Priority Data

Jun. 22, 1988 [BE] Belgium ..... 8800714

[51] Int. Cl.[5] ..... B61F 5/00

[52] U.S. Cl. ..... 105/168; 105/218.2

[58] Field of Search ..... 105/165, 167, 168, 169, 105/170, 174, 175.1, 178, 190.1, 206.1, 198, 207, 218.2

[56] References Cited

U.S. PATENT DOCUMENTS 4,459,919 7/1984 Lemaire et al. ..... 105/169

FOREIGN PATENT DOCUMENTS 0168578 1/1986 European Pat. Off. .
3119163 12/1982 Fed. Rep. of Germany ..... 105/168
3342968 3/1984 Fed. Rep. of Germany .
1431055 1/1966 France ..... 105/168
WO8808802 11/1988 World Int. Prop. O. .

*Primary Examiner*—Robert J. Oberleitner
*Assistant Examiner*—Mark T. Le
*Attorney, Agent, or Firm*—Sughrue, Mion, Zinn, Macpeak & Seas

[57] ABSTRACT

The articulated device for the guidance and levitation of a rail vehicle is composed of a deformable support equipped with at least four independent wheels and comprising a horizontal crossmember and two longitudinal members pivotable and tiltable relative to the crossmember. The two longitudinal members, each equipped with at least two wheels and mounted longitudinally on articulated elements, carry the crossmember on either side of the longitudinal vertical plane of the vehicle, so as to be directionally pivotable in a horizontal plane and, on the other hand, tiltable in a vertical plane in order to make it possible for the wheels carried by the longitudinal members connected to one another by means of a link and ball-mounted to follow the curves of the track and pass over the inequalities of the latter. According to the invention, the crossmember, at its ends, carries pivots for the articulation of longitudinal members, having variable relative positions. This results in a compensation of the loss of distance between the longitudinal members, occurring during this rotation, and therefore a constant matching between the spacing of the wheels and the width of the track.

14 Claims, 9 Drawing Sheets

ARTICULATED DEVICE FOR THE GUIDANCE AND LEVITATION OF A RAIL VEHICLE

BACKGROUND OF THE INVENTION

The present invention relates to an articulated device for the guidance and levitation of a rail vehicle, the said device being composed of a deformable support equipped with at least four independent wheels and comprising a horizontal substantially crossmember secured to this vehicle body, so as to be perpendicular to the longitudinal axis of the body in the vicinity of one end of this body, and two longitudinal members, each equipped with at least two wheels and mounted longitudinally on a substantially vertical pivot of an articulated element carrying the crossmember on either side of a vertical plane containing this longitudinal axis, so as to be directionally pivotable in a horizontal plane and, on the other hand, tiltable in a vertical plane in order to make it possible for the wheels carried by the longitudinal members connected to one another by means of a ball-mounted link to follow the curves of the track and pass over the inequalities of the latter.

It is used mainly in urban transport, especially when the route has curves of small radius, when the track infrastructure requires light-weight and compact guidance and levitation devices, or when traffic corridors which are low and of large width have to be arranged in line with the said devices.

A large number of devices for the levitation of rail vehicles, capable of ensuring the dynamic stability of these vehicles, both along a straight path and along a curved path, is already known.

European patent No. 60,000 describes a device for the levitation and guidance of a rail vehicle, equipped with at least four wheels mounted on a support intended to be secured to the body of a vehicle in the vicinity of one end of this body.

This device is composed of a crossmember maintained perpendicular to the vertical plane containing the longitudinal axis of the vehicle and of two longitudinal members which, in the operating position, are arranged in the longitudinal direction of the body on either side of the abovementioned vertical plane. These longitudinal members are connected to one another by means of a ball-mounted linkage. They are articulated on the common crossmember by means of vertical pivots capable of assuming a certain inclination in the substantially vertical longitudinal plane. These pivots are connected to one another by means of ball joints and a rocker fixed to the crossmember by means of a pivot perpendicular to the plane formed by the crossmember and the longitudinal axis of the vehicle.

On bends or curves, the long.itudinal members pivot relative to the crossmember about substantially vertical pivots and form the opposite sides of a deformable trapezium, whilst the crossmember remains perpendicular to the longitudinal axis of the vehicle body.

Belgian patent 8,700,527 describes a device similar to that described in the abovementioned European patent. Each of the two longitudinal members carrying the independent wheels is composed of two sections articulated about vertical pivots, each section carrying at least one wheel and being directionally controlled by a system of ball-mounted linkages.

On bends or curves, the sections of the longitudinal members pivot relative to the crossmember and relative to their other section and form the sides of two deformable trapezia, whilst the crossmember remains perpendicular to the vehicle body, the advantage of this second device over the first being that each wheel is oriented tangentially relative to the track portion on which it bears.

In both devices, because the longitudinal members oscillate directionally about two separate pivots, the distances between the planes of the left and right wheels decrease progressively at the start of travel in a straight line and on sharp bends reach values incompatible with those of the track, so that travel on a track of small radius of curvature, with grooved rails and non-worn wheels, becomes impossible without causing jamming and risking derailment.

SUMMARY OF THE INVENTION

The object of the present invention is to overcome this disadvantage.

It provides a device which makes it possible to move the articulation pivots of the two longitudinal members away from one another in order to compensate the loss of spacing of the longitudinal members attributable to the swivelling of these when the vehicle is entering a bend (curves), and which returns the abovementioned articulation pivots to their initial position when the vehicle comes out of a bend (curve) and begins to follow a straight line.

Its subject is a device for the guidance and levitation of a rail vehicle, which is composed of a deformable support with independent wheels capable of pivoting about vertical axes, so as to be oriented in pairs or independently as a function of the track portion on which they bear.

The deformable support comprises a crossmember secured to a body of the vehicle, so as to be perpendicular to the vertical plane containing the longitudinal axis of the vehicle in the vicinity of one end of this body, and two longitudinal members which, in the operating position, are arranged in the longitudinal direction of the body on either side of the abovementioned vertical plane.

These longitudinal members can be rigid or formed from two articulated sections, each rigid longitudinal member carrying at least two wheels or each longitudinal-member section carrying at least one wheel and being capable of oscillating on articulated elements carried by the crossmember on either side of the abovementioned vertical plane, in order to make it possible for the wheels carried by the longitudinal members to follow the curves of the track and pass over the inequalities of the latter.

This device is characterized essentially in that each articulated element carrying a vertical pivot for the articulation of a longitudinal member is mounted in regard to said pivot, so as to change or vary the position of the pivots relative to one another and make it possible, when the device is entering a bend, to correct the distance between the vertical planes containing the wheels of each of the longitudinal members in such manner that said distance corresponds to the width of the track.

In a first particular embodiment, one of the means of articulation is composed of a crankshaft comprising three vertical pitots in the form of axles, the main axle of which pivots in the crossmember, one of the crank pins carries a rigid longitudinal member or a section of this, whilst the other crank pin opposite it at substantially 180° carries a link ball-mounted and extending substantially transversely relative to the vehicle, so as to be ball-mounted at its other end on a substantially perpendicular arm fixed to the opposite rigid longitudinal member or to a section of this.

In a second embodiment, the articulated element is a rocker comprising three vertical pivots in for form of axles, of which a substantially vertical main axle pivots in a crossmember and a first auxiliary axle of which carries a longitudinal member, whilst a second auxiliary axle substantially opposite at 180° carries a link ball-mounted and extending substantially transversely relative to the vehicle, in order to be ball-mounted at its other end on a substantially perpendicular arm fixed to the opposite rigid longitudinal member or to a section of this.

Finally, in a third embodiment, the articulated element is composed of a substantially vertical pivot carried by a slide mounted on the crossmember and terminating in a ball joint of a link mounted, at its other end, on an arm fixed to the longitudinal member in directional terms and moving away substantially horizontally and perpendicularly relative to the longitudinal member from the axis of the deformable support equipped with at least four wheels.

Other particular features and details of the invention will emerge from the following description of the drawings which accompany this specification and which illustrate diagrammatically a preferred embodiment of the guidance and levitation device according to the invention.

DETAILED DESCRIPTION OF THE DRAWINGS

In these various Figures, the same reference symbols denote identical or similar elements.

As illustrated in FIGS. 1, 2, 4 and 5, the device, designated as a whole by the reference symbol 1 for the guidance and levitation of a rail vehicle is a deformable support equipped with at least four independent wheels and intended for carrying a body or a body part 2 of the abovementioned rail vehicle.

Figure 1:
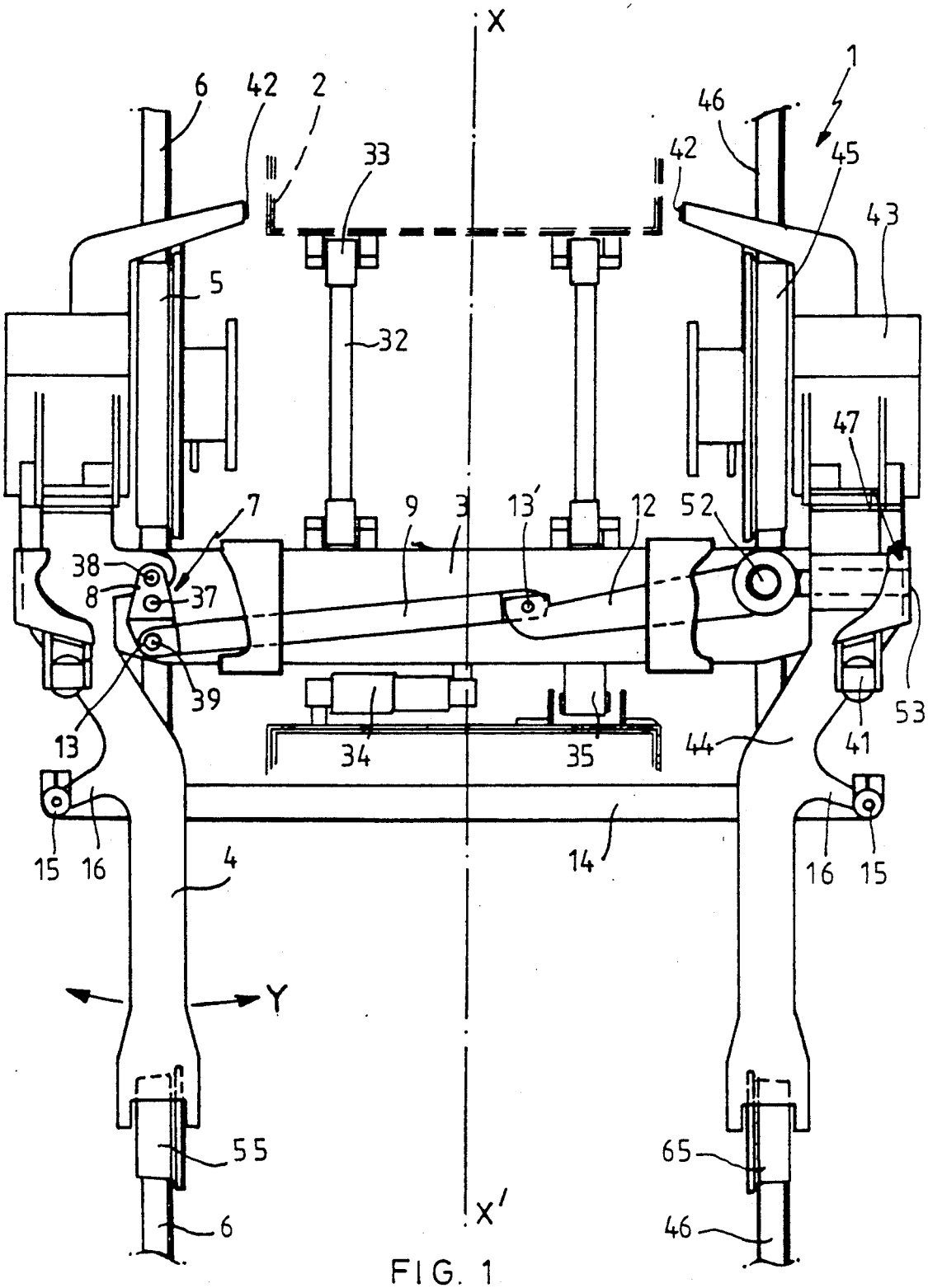
FIG. 1 is a plan view of a preferred embodiment of the device according to the invention, on a straight path.
Figure 2:
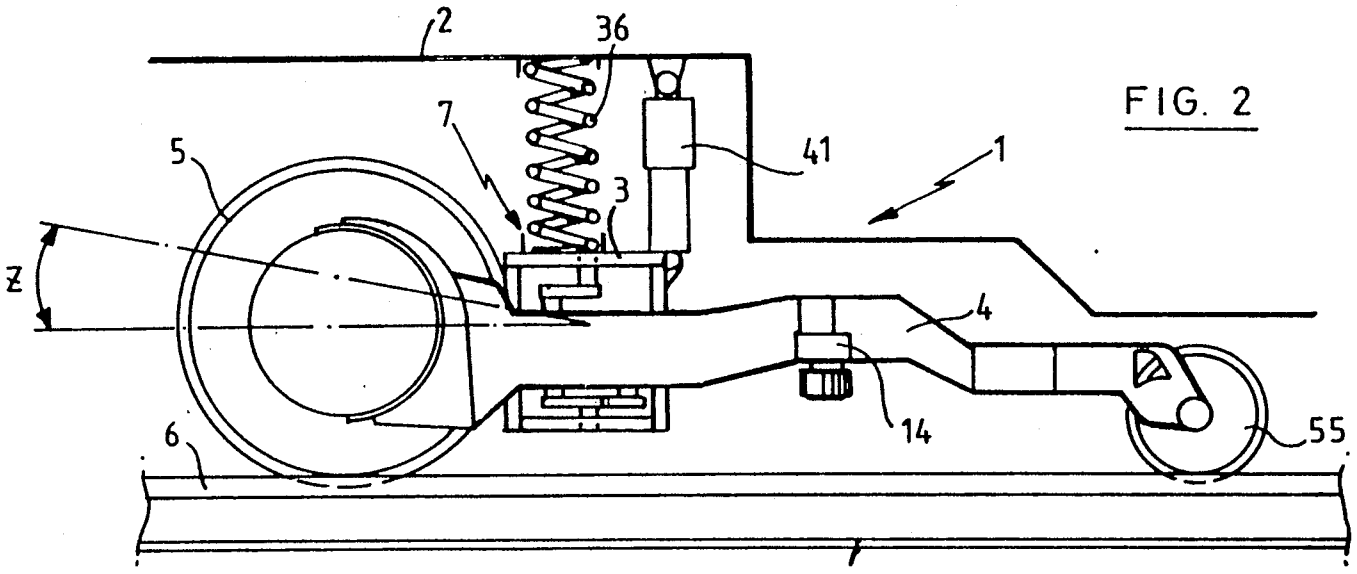
FIG. 2 is a side elevation view of the device illustrated in FIG. 1.

The floor is represented by broken lines in the abovementioned FIGS. 1 and 2, in the vicinity of one end of this body 2. This device 1 comprises a crossmember 3 arranged perpendicularly relative to the vertical plane containing the longitudinal axis X—X' of the body 2, and two longitudinal members 4, 44 which, in the operating position of the device, extend in the longitudinal direction of the body 2 on either side of the vertical plane containing the longitudinal axis X—X'.

Each of these longitudinal members carries at least two wheels 5, 55 and 45, 65, motor-driven or not, which are intended for rolling on the same rails 6, 46.

According to a first possibility, on the left longitudinal member 4 there is an articulated element which is shown in FIGS. 1 to 6 and is designated as a whole by the reference symbol 7 and which carries the crossmember 3, in such a way that it is directionally pivotable in the direction of the arrows Y.

In a first embodiment, the articulated element 7 is composed of a crankshaft 8 (FIG. 4), of which the substantially vertical main axle 37 pivots in the crossmember 3, a crank pin 38 pivots in the longitudinal member 4 and another crank pin 39 substantially opposite at 180° pivots in a link 9 by means of a ball joint 13.

Figure 5:
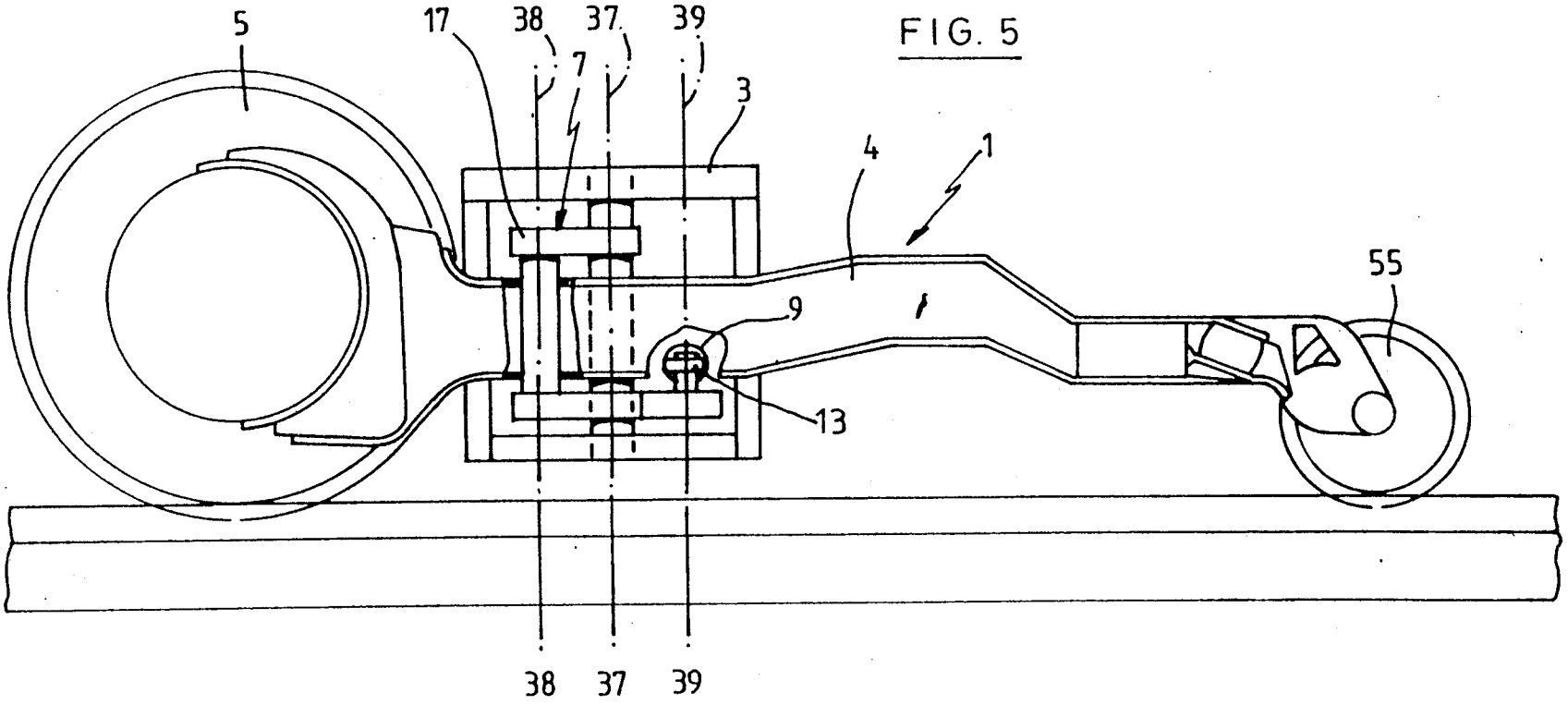
FIG. 5 shows an articulation assembly of the "rocker" type.
Figure 6:
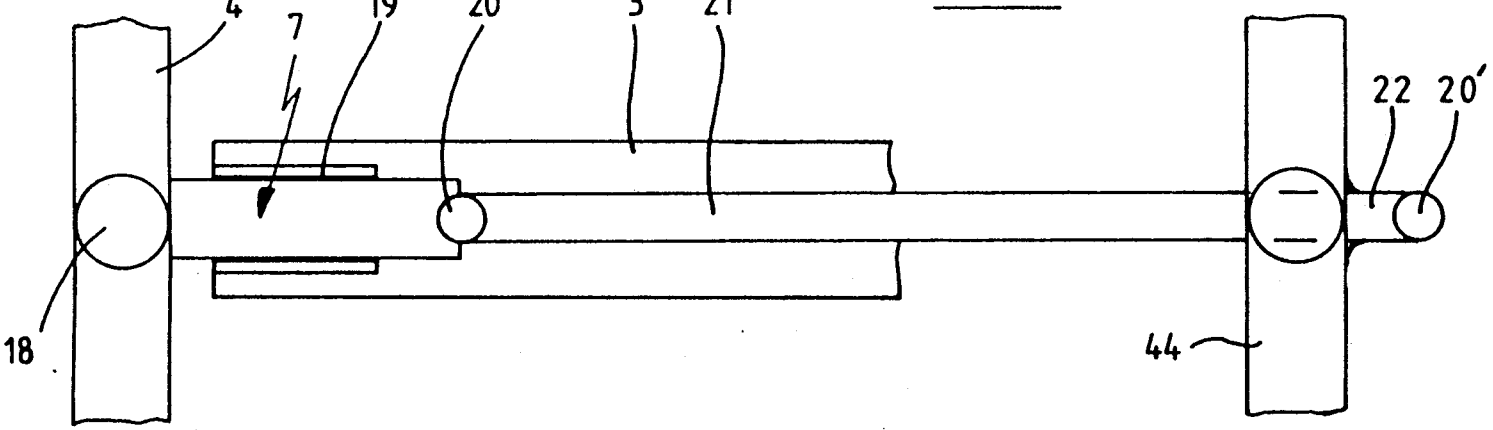
FIG. 6 shows an articulation assembly of the "slide" type.

In a second embodiment illustrated in FIG. 5, the articulated element 7 is a rocker 17 carrying the crossmember 3, in such a way that it is directionally pivotable there in the direction of the arrows Y.

The rocker comprises three vertical pivots embodied by a main axle 37 carried by the crossmember 3 and by two auxiliary axles 38, 39, of which the first carries a longitudinal member 4 and the second carries a link 9 by means of a ball joint 13.

In a third embodiment, the articulated element 7 can be composed of the substantially vertical pivot 18 carried by a slide 19 mounted on the crossmember 3 and terminating in a ball joint 20 provided at one end of a link 21 which is mounted at its other end by a ball mount 20' provided on an arm 22 that is directionally fixed to the longitudinal member 44.

Figure 7:
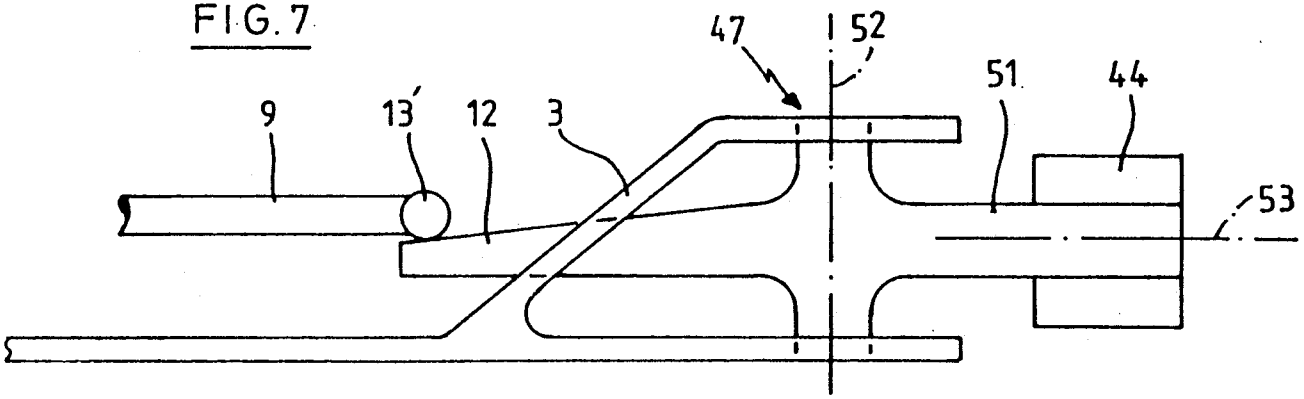
FIG. 7 shows an articulation assembly of the "crossbar" type.
Figure 8:
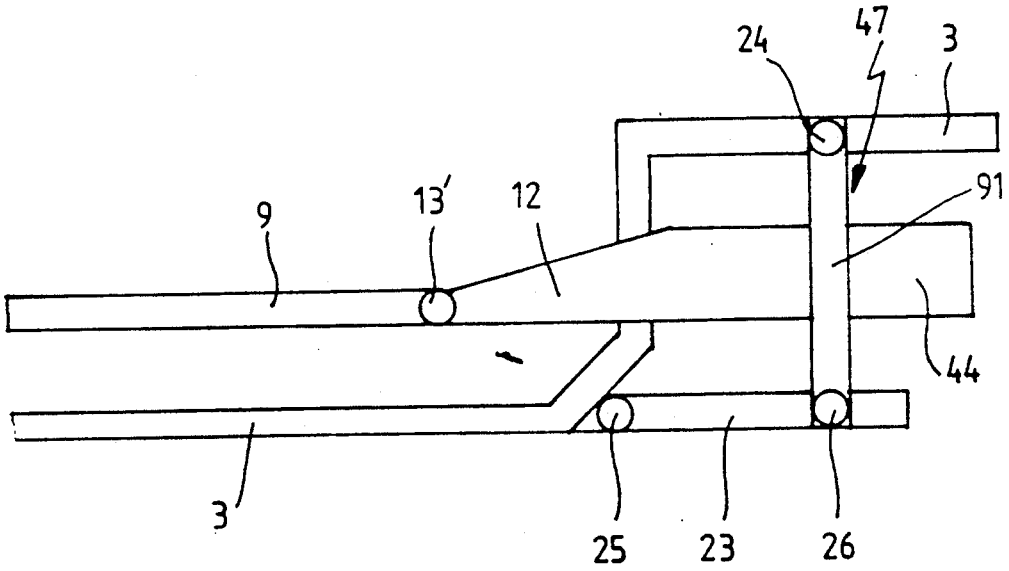
FIG. 8 shows an articulation assembly of the "ball-joint" type.

In this first possibility, there is on the right longitudinal member 44, as illustrated in FIGS. 7 and 8, an articulated element which is designated as a whole by the reference symbol 47 and which carries the crossmember 3, in such a way that the longitudinal member is directionally pivotable in a horizontal plane in the direction of the arrows Y (FIG. 1) and, on the other hand, tiltable in a vertical plane in the direction of the arrows Z (FIG. 2).

In a first embodiment illustrated in FIG. 7, the element 47 is composed of a crossbar 51 having a vertical axle 52 pivoting in the crossmember 3 and a substantially horizontal axle 53 pivoting in the longitudinal member 44, relative to which it is substantially perpendicular, as seen in a plan view.

The crossbar 51 has an arm 12 directed substantially horizontally and perpendicularly relative to the longitudinal member 44 towards the longitudinal axis of bogie and carrying a ball joint 13' pivoting in the abovementioned link 9.

In a second embodiment, the articulated element 47 is composed of a substantially vertical pivot 91 which, as shown in FIG. 8, is articulated on the crossmember 3 by means of ball joints 24, 26 and a link 23 articulated on the crossmember 3 by means of the ball joint 25.

The pivot 91 and the link 23 allow the longitudinal member 44 to pivot directionally in the direction of the arrows Y and, on the other hand, to tilt in the direction of the arrows Z.

Figure 9:
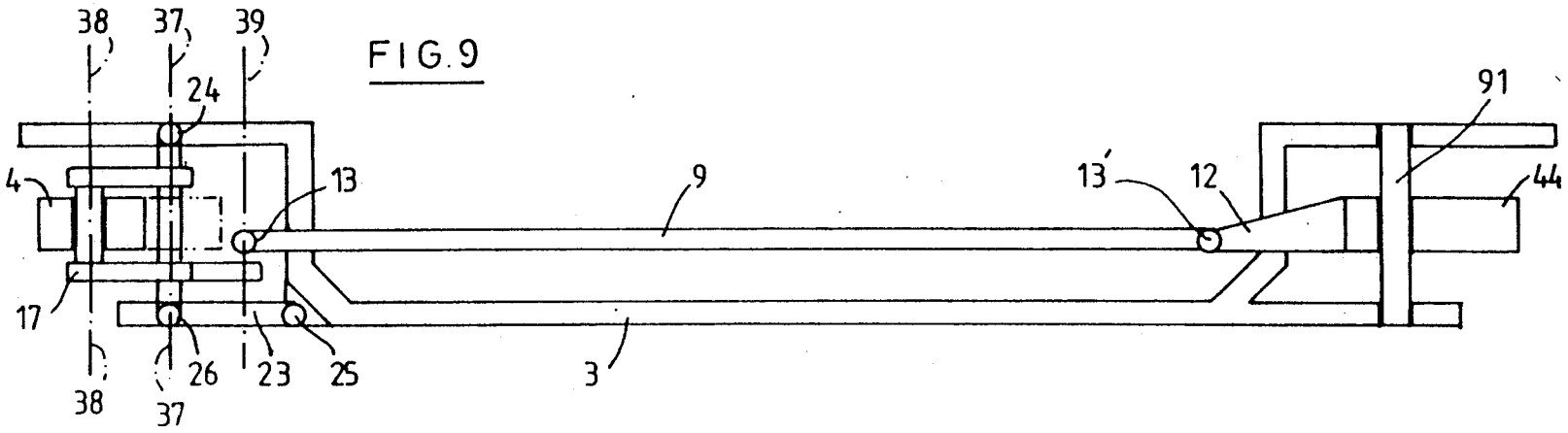
FIG. 9 shows two articulation assemblies, of which one is obtained as a result of the combination of the crankshaft-type or rocker-type articulation with an articulation assembly of the ball-joint type and the other is a simple pivot.

FIG. 9 illustrates, on the left-hand side, a second possibility which arises as a result of the combination of the articulated elements 7 and 47 with one another, both being mounted on one side of the device 1.

This combination is obtained by securing the main vertical axle of the articulated element 7 carrying the longitudinal member 4 to the crossmember 3 by means of balls 24, 26 and a link 23, in a similar way to that illustrated on the right-hand side of FIG. 8, in order to give this articulated element 7 an additional degree of freedom of movement thanks to which this longitudinal member is allowed not only to pivot directionally in the direction of the arrows Y, but also to tilt in the direction of the arrows Z, in order to compensate an inequality of the track.

The double freedom of the longitudinal member 4 makes it possible to simplify the mounting of the longitudinal member 44, for which a vertical pivot 91 oscillating in the crossmember 3 is sufficient to ensure the directional guidance of the said longitudinal member 44 in the direction of the arrows Y, since the crossmember 3 carrying this vertical pivot can pivot to some extent about a substantially horizontal axis having a direction transverse relative to the rail.

In this second possible embodiment, the articulated element 7 gives the longitudinal member 4 two degrees of freedom limited to the pivotings according to Y and Z, as mentioned above, whilst the third degree of freedom is cancelled by a supporting arm 23 ball-mounted 25, on the one hand, on the crossmember 3 and, on the other hand, via a ball joint 26 on the vertical axle 37 carrying the longitudinal member 4.

The directional rotations of the longitudinal members 4 and 44 are coordinated by means of a second link 14 ball-mounted 15 on appendages 16 of the longitudinal members 4 and 44 and thus determine the rotation of the arm 12.

According to the invention, the position of the articulated elements 7, 47 in relation to the wheels, 5, 55 and 45, 65 on the longitudinal members 4, 44 or sections 27, 28, 57, 58 is selected: (a) in the transverse plane, in such a way that differential resistances, rolling, tractive forces or braking forces between left wheels, 5, 55 and right wheels 45, 65 determine a minimum rotational torque about vertical axes of the articulated elements 7, 47; (b) in the longitudinal plane, in such a way that masses carried by the crossmember 3 determine, in the region of the wheels 5, 45 and 55, 65, the desired mass distribution for best ensuring the grip requirements both under traction and under braking; and (c) likewise in the longitudinal plane, in such a way that, as seen in the plane view, the centre of gravity of the bogie is as near as possible to the axis transverse relative to the vehicle connecting these articulated elements 7, 47.

Figure 3:
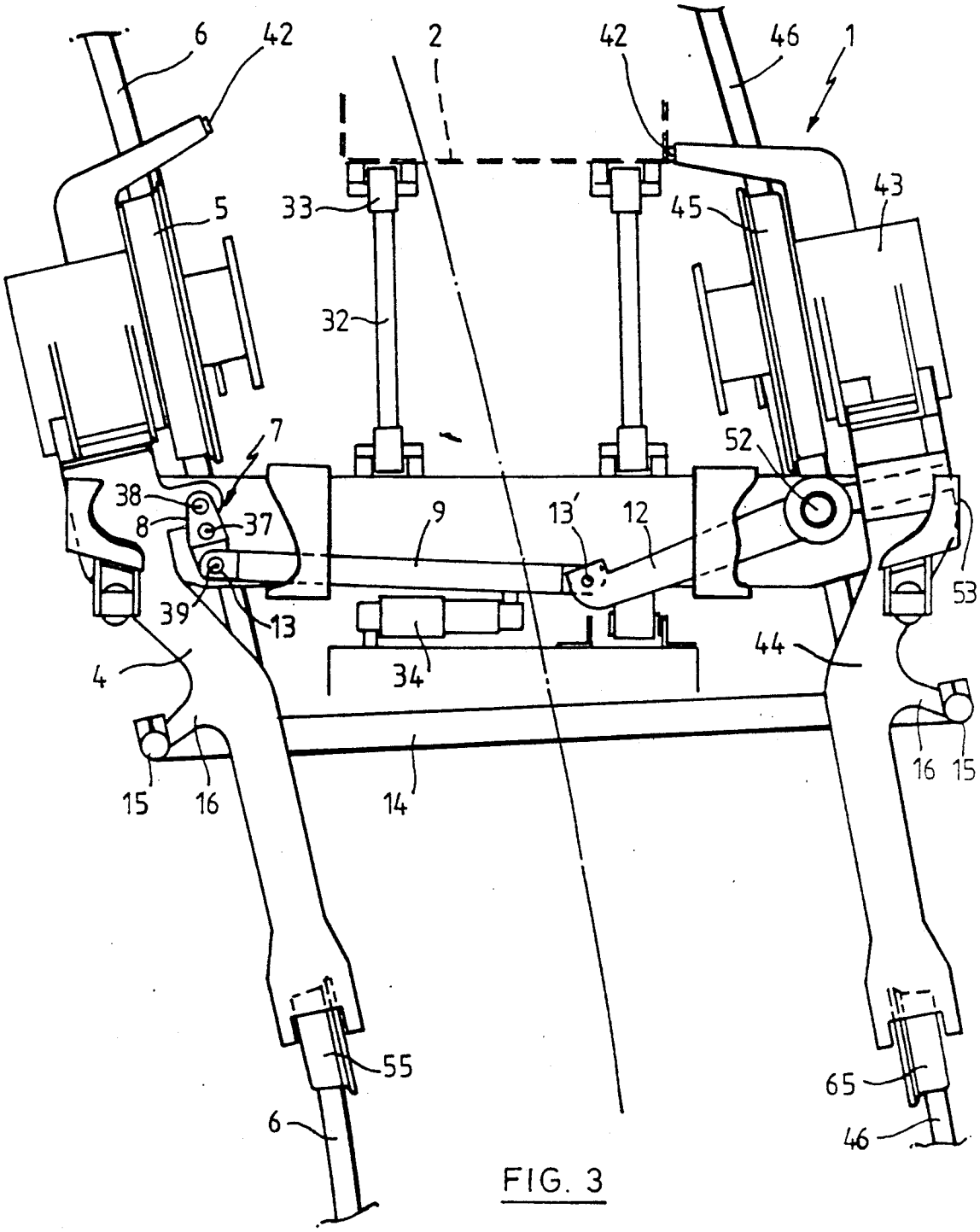
FIG. 3 is a plan view similar to that of FIG. 1, showing the devices according to the invention entering a bend of a railway track.
Figure 4:
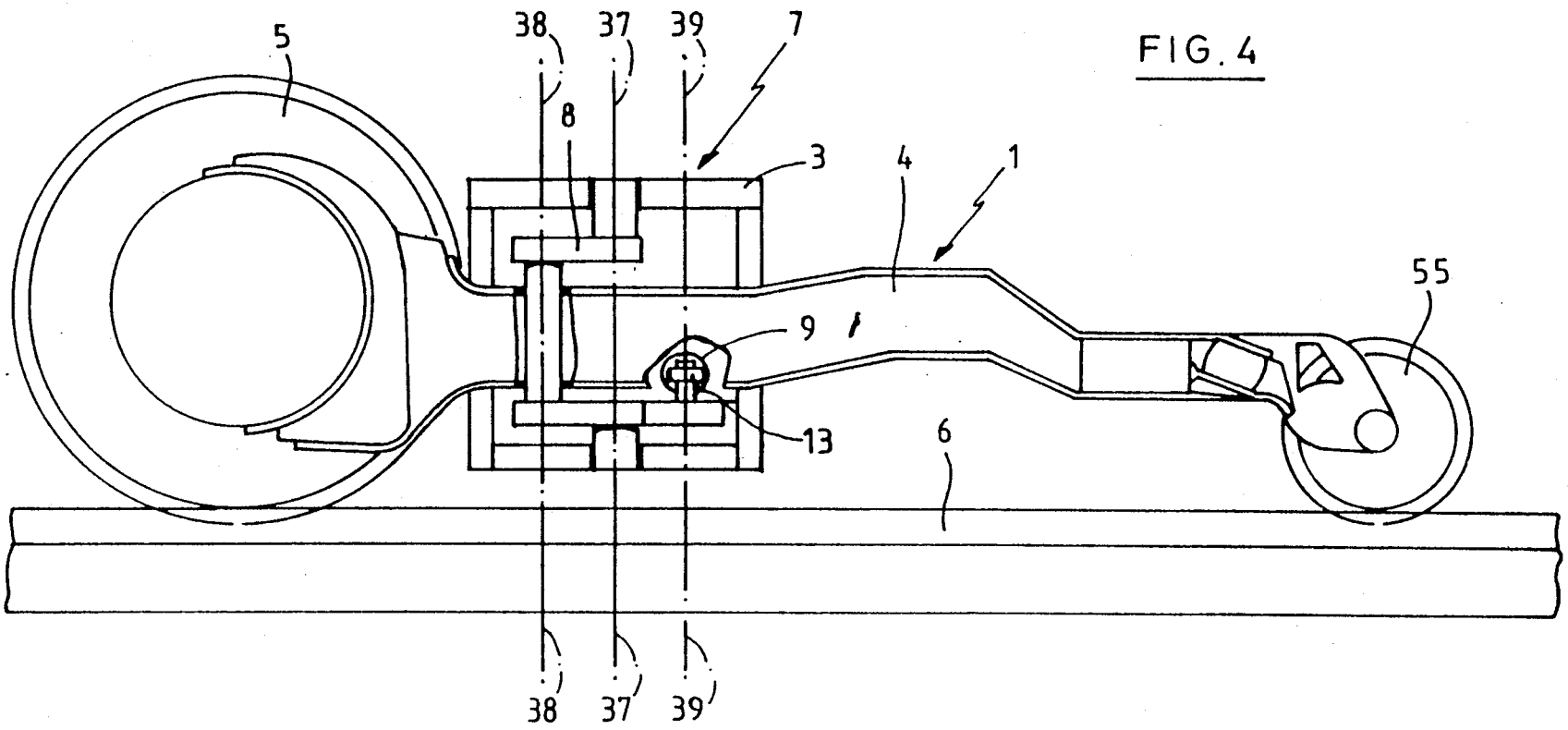
FIG. 4 shows an articulation assembly of the "crankshaft" type.

FIG. 3 illustrates the device 1 according to the invention shown in FIGS. 1 and 2 when it is entering a bend or curve.

Whatever the orientation of the curve to the left or to the right, the two longitudinal members 4 and 44 oscillate directionally in relation to the crossmember 3 in a way coordinated by the link 14 and in their rotation drive the arm 12, moving the ball joint 13' over an arc and driving the link 9 which, when the device was rolling in a straight line, was aligned substantially towards the vertical axis defining the circle including this arc.

The link 9 drives the crank-shaft 8 in rotation by means of its crank pin 39 and therefore moves the crank pin 38 and the longitudinal member 4 which it carries in a direction transverse relative to the rail 6 towards the outside of the track and over a distance substantially proportional to the radius of curvature of the track, thus correcting, by means of this extra width imposed on the wheel support, the reduction of width occurring as a result of its oscillation.

The deformable support equipped with at least four wheels 5, 55 and 45, 65, according to the invention, therefore automatically and permanently maintains a nominal width between wheels which corresponds to the width of the track.

When the device is passing over an inequality of the track, the substantially horizontal axle 53 allows the longitudinal member 44 to oscillate according to the arrows Z, that is to say in a longitudinal vertical plane relative to the vehicle, in relation to the assembly composed of the longitudinal member 4 and of the crossmember 3 which have only a single degree of directional freedom relative to one another.

This freedom eliminates any torsional stress in the region of the longitudinal members and crossmember, whether the wheels are mounted on the longitudinal members 4, 44 rigidly or by means of primary suspensions.

Figure 10:
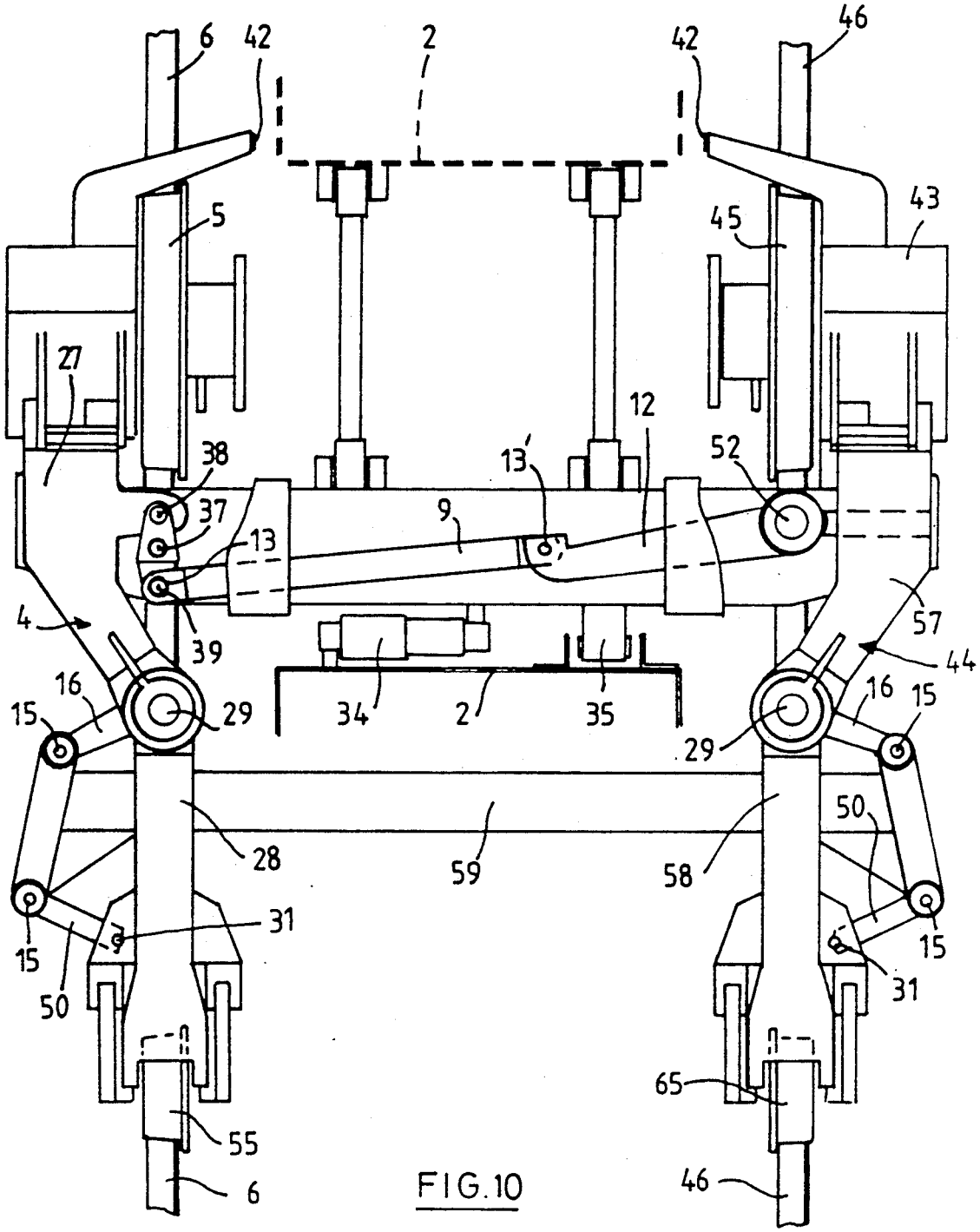
FIG. 10 is a plan view of the embodiment of the device according to the invention, combined with an embodiment of the longitudinal members in sections, which is controlled independently in terms of the directional plane and which comes onto a track portion in the form of a straight line.
Figure 11:
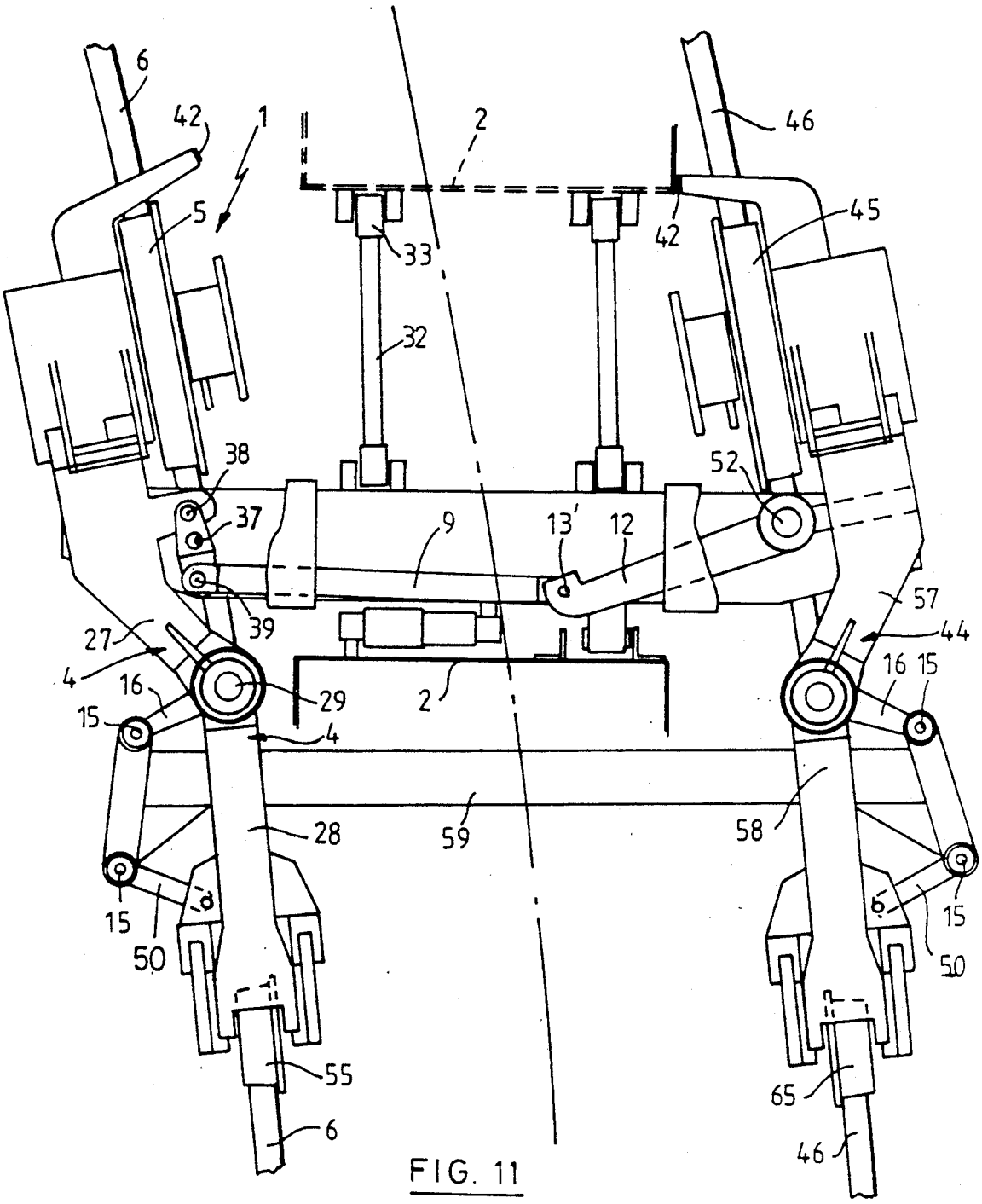
FIG. 11 is a view similar to that of FIG. 10 showing the device according to the invention entering into a bend or curve of a railway track.

Alternatively, according to FIGS. 10 and 11, the bogie with independent wheels, as described above, can comprise a crossmember 3 and two longitudinal-member assemblies 4, 44, the latter being composed of sections 27, 28 and 57, 58 articulated relative to one another on substantially vertical pivots 29, each section having at least one wheel 5, 45, and 55, 65 and one of them being mounted on the crossmember 3 by means of one of the articulated elements 7, 47, as described above.

The directional rotations of the sections 27, 57 are coordinated by the link 59 ball-mounted 15 on the appendages 16 of the said sections and determine the rotation of the arm 12.

The directional rotations of the sections 27, 28, 57 and 58 are coordinated by links 50 mounted on pivots 31 on the said sections and ball-mounted 15 on the abovementioned link 59.

The pivoting of the two sections about a vertical axis makes it possible directionally to orient each wheel 5, 55 and 45, 65 independently, in order to allow it to approach as close as possible to the tangent to the rail section on which it bears, thereby ensuring that these have the correct attitude about the centre of curvature of the track.

When the device is entering a bend, the extra-width correction takes place automatically, as described above, whilst the sections 27, 28 and 57, 58 of the longitudinal members 4, 44, are oriented so as to align each wheel 5, 45, 55 and 65 automatically tengentially relative to the track portion on which it bears.

The device according to the invention thus automatically and premanently maintains both a nominal width between the wheels 5, 45 and 55, 65, corresponding to the width of the track, and a perfect alignment of these towards the instantaneous centre of rotation corresponding to the centre of curvature of the track.

The crossmember 3 is positioned relative to the body 2 of the vehicle by means of parallel links 32 which are ball-mounted 33, the lateral deflections being controlled by a shock absorber 34 and stops 35.

A so-called secondary suspension between the device 1 and the body 2 is composed of helical or pneumatic springs 36 mounted between the crossmember 3 and the body 2 and of shock absorbers 41 mounted nearby.

The vehicle body 2 is intended to provide a low corridor of maximum width and volumes making it possible to install seats on either side of the corridor, in order to obtain the best conditions of comfort, safety and roominess, whilst at the same time performing its structural function.

To increase the width of the corridor, shoes 42 fixed to the longitudinal members 4, 44 or sections 27, 57 are provided for pushing back the body 2 on sharp bends, in order not only to return it into the axis of the crossmember 3, eliminating the transverse play of the suspension 36 towards the outside of the bend, but also to push it beyond the axis of the crossmember 3, thereby reducing this play towards the inside of the bend.

The body is thus pushed towards the centre of the curvature of the track, the additional effect of this being to reduce its external dimension towards the outside of the bend.

Each wheel located near the means of articulation 7 and therefore supporting a large proportion of the masses can be mounted on an independent geared-motor assembly 43 mounted on a longitudinal member 4 or 44.

The guidance and levitation device which is the subject of the present invention can be equipped with auxiliary appliances, such as motors, disc brakes, brakes with a magnetic shoe on rails, anti-derailment stops and a so-called primary suspension between the wheels 5, 45, 55 and 65 and longitudinal members 4, 44.

It also makes it possible to preserve the many advantages already mentioned in European patent 60,000 and Belgian patent 8,700,527 mentioned above.

In particular, it can be associated with the device for the automatic convergence of the four wheels of the bogie towards the instantaneous centre of rotation corresponding to the centre of curvature of the track, as described in the patent 8,700,527, in such a way that perfect matches of widths between the wheels and of the orientation of these can be obtained, whatever the curvature of the track.

The device adapts kinematically, without generating stresses or return forces.

Consequently, the load distribution between the wheels 5, 45 is virtually independent of the external elements, such as the cant, track inequalities and the movements of the vehicle body. Dynamic stability is also improved and the risks of derailment are reduced. Moreover, less noise is generated and there is less wear of the wheels and rails on the bends of the track.

According to the invention, the position of the articulated elements 7, 47 in relation to the wheels 5, 55 and 45, 65 on the longitudinal members 4, 44 or sections 27, 28, 57, 58 is selected: (a) in the tranverse plane, in such a way that differential resistances, rolling, tractive forces or braking forces between left wheels 5, 55 and right wheels 45, 65 determine a minimum rotational torque about vertical axes of the articulated elements 7, 47; (b) in the longitudinal plane, in such a way that masses carried by the crossmember 3 determine, in the region of the wheels 5, 45 and 55, 65, the desired mass distribution for best ensuring the grip requirements both under traction and under braking; and (c) likewise in the longitudinal plane, in such a way that, as seen in the plan view of FIG. 1 for example, the center of gravity of the bogie is as near as possible to the axis transverse relative to the vehicle connecting these articulated elements 7, 47.

It is clear that the invention is not limited to the details described above for obtaining the pivoting, tilting and spacing of the longitudinal members 4, 44, and that many modifications can be made to these details without departing from the scope of the invention.

The longitudinal members 4, 44 can have a form different from that shown in FIGS. 1 and 2 and, for example, can be rectilinear. In that case, the wheels 5, 55 and 45, 65 are mounted on the same side of the longitudinal member 4, 44.

They can also be carried by the crossmember 3, so as to obtain a different distribution of the masses on their respective wheels 5, 55.

What we claim is:

1. An atriculated device for guidance and levitation of a rail vehicle, said device being composed of a deformable support equipped with at least four independent wheels adapted to ride on spaced rails defining the width of a track, and comprising:

a substnatially horizontal crossmember secured to a vehicle body, so as to be perpendicular to a first vertical plane containing a longitudinal axis (x,x') of the body in the vicinity of one end of this body; and two longitudinal members, each equipped with at least two wheels and mounted longitudinally on a substantially vertical pivot of an articulated element carrying the crossmember on either side of said first vertical plane, so as to be, on the one hand, directionally pivotable in a horizontal plane in a first direction and, on the other hand, tiltable in a second direction in a second vertical plane parallel to said first vertical plane about a substantially horizontal pivot, to cause the wheels carried by the longitudinal members, connected to one another by means of a ball-mounted link, to follow curves of the track and pass over inequalities of the track;

wherein at least one of said articulated elements including means for displacing its vertical pivot relative to the vertical pivot of the other of said articulated elements so as to change the relative positions of the vertical pivots and to make it possible to correct the distance between vertical planes containing the wheels of each of the longitudinal members, when the device is entering a curve in the track, in such manner that said distance corresponds to the width of the track.

2. A device as claimed in claim 1, comprising mounting means for eccentrically mounting said one articulated element relative to its vertical pivot to vary the relative position of the vertical pivots.

3. A device as claimed in claim 1, wherein each longitudinal member is composed of sections articulated relative to one another on substantially vertical pivots, each section carrying at least one wheel.

4. A device as claimed in claim 1, wherein one of the articulated elements is a crank-shaft comprising three vertical pivots of which a substantially vertical main axle pivots in the crossmember, a first crank pin pivots in the longitudinal member and another crank pin substantially opposite it carries a link ball-mounted and extending substantially transversely relative to the vehicle, so as to be ball-mounted at its other end on a substantially perpendicular arm directionally fixed to the opposite longitudinal member or to a section thereof.

5. A device as claimed in claim 4, wherein the main vertical axle of said one of the articulated elements is mounted on the crossmember at its upper end by means of a ball joint and at its lower end by means of a substantially horizontal link articulated on the main axle and on the crossmember by means of ball joints, so as to allow the longitudinal member to pivot directionally in said first direction and tilt in said second direction.

6. A device as claimed in claim 5, wherein the other of the articulated elements is composed of a crossbar, of which a substantially vertical axle pivots in the crossmember and a substantially horizontal axle pivots in the longitudinal member, relative to which it is substantially perpendicular, and said crossbar including an arm directed substantially horizontally and perpendicularly relative to the longitudinal member towards the longitudinal axis (x,x') and carrying a ball joint pivoting in said link.

7. A device as claimed in claim 1, wherein one of the articulated elements is a rocker comprising three vertical pivots, of which a substantially vertical main axle pivots in the crossmember and of which a first auxiliary axle carries a longitudinal member, whilst a second auxiliary axle substantially opposite carries a link ball-mounted and extending substantially transversely relative to the vehicle, so as to be ball-mounted at its other end on a substantially perpendicular inner arm fixed directionally to the opposite longitudinal member or to a section thereof.

8. A device as claimed in claim 1, wherein one of the articulated elements is composed of a ball joint pivoting in the crossmember, and has degrees of freedom of movement which are limited to the aforementioned pivoting and tilting in said first and second directions, a third degree of freedom of movement being cancelled by the link ball-mounted, on the one hand, on the crossmember and, on the other hand, substantially vertically in line with the ball joint on the longitudinal member.

9. A device as claimed in claim 1, wherein the crossmember comprises a slide.

10. A device as claimed in claim 9, wherein one of the articulated elements is composed of a substantially vertical pivot carried by the slide mounted on the crossmember and terminating a ball joint connected to one end of a link which, at its other end, is connected to a ball-mount provided on an outer arm that is directionally fixed to one of the longitudinal members.

11. A device as claimed in claim 1, wherein shoes fixed to the longitudinal members are provided for pushing the body towards the centre of track curvature in sharp bends and counter to centrifugal force and for reducing freedoms of movements of the vehicle body so as to make it possible to arrange a wider body corridor for a body's predetermined outer dimension.

12. A process for the guidance and levitation of a rail vehicle by means of an articulated guidance and levitation device as claimed in claim 1 on a constant-gauge rail network, comprising moving at least one of the articulated elements, carried by the crossmember on either side of the abovementioned first vertical plane, transversely relative to this plane in order, on a bend, to compensate the reduction of the distance between the longitudinal members.

13. A process as claimed in claim 12, comprising varying the relative position of the pivots for the articulation of the two longitudinal members as a function of the directional orientation of the longitudinal members.

14. A process as claimed in claim 12, comprising selecting the position of the articulated elements in relation to the wheels on the longitudinal members or, sections:

in the transverse plane, in such a way that differential resistances, rolling, tractive forces or braking forces between left and right wheels determine a minimum rotational torque about vertical axes of the said articulated elements, in the longitudinal plane, in such a way that masses carried by the crossmember determine, in the region of the wheels, desired mass distribution for best ensuring grip requirements both under traction and under braking, likewise in the longitudinal plane, in such a way that, the centre of gravity of a bogie of the rail vehicle is as near as possible to the axis transverse relative to the vehicle connecting these articulated elements.

* * * * *